United States Patent [19]

Wollnik

[11] 4,187,485

[45] Feb. 5, 1980

[54] COIL ARRANGEMENT FOR ELECTROMAGNETICALLY INFLUENCING MAGNETIC FIELDS, IN PARTICULAR FOR HOMOGENIZING MAGNETIC DIPOLES

[76] Inventor: Hermann Wollnik, No. 30, Auf der Platte, 6301 Fernwald, Fed. Rep. of Germany

[21] Appl. No.: 859,910

[22] Filed: Dec. 12, 1977

[30] Foreign Application Priority Data

Dec. 31, 1976 [DE] Fed. Rep. of Germany ..... 2659775

[51] Int. Cl.[2] ..... H01F 5/00

[52] U.S. Cl. ..... 335/299; 335/209; 336/200

[58] Field of Search ..... 335/299, 297, 282, 213, 335/210, 209; 336/200

[56] References Cited

U.S. PATENT DOCUMENTS

| | | | |
|---|---|---|---|
| 2,962,636 | 11/1960 | Purcell | 336/234 |
| 3,702,450 | 11/1972 | Avery et al. | 336/200 |

OTHER PUBLICATIONS

Nuclear Instruments and Methods, Title "Field Correction Windings For Iron Magnets", vol. No. 3, 3/73, pp. 515–518.

IBM Technical Disclosure Bulletin, vol. 19, No. 12, 5/77.

*Primary Examiner*—Harold Broome

*Attorney, Agent, or Firm*—John C. Smith, Jr.

[57] ABSTRACT

A coil arrangement for the electromagnetic superimposition and correction of magnetic fields and generation of magnetic fields of a desired locus dependent distribution comprises coils formed in an areal arrangement in accordance with the art of printed circuits and serving the purpose of generating magnetic fields, homogenizing deviations from a desired distribution.

10 Claims, 10 Drawing Figures

COIL ARRANGEMENT FOR ELECTROMAGNETICALLY INFLUENCING MAGNETIC FIELDS, IN PARTICULAR FOR HOMOGENIZING MAGNETIC DIPOLES

BACKGROUND OF THE INVENTION

This invention relates to a coil arrangement which permits imposition upon the magnetic field of a dipole arrangement a desired field distribution or compensation for an undesired field distribution. The coils are arranged between the pole shoes of a magnet.

In electron and ion optics, magnetic fields are employed which realize a predetermined field distribution over a large area (reported in: H. Wollnik; Nuclear Instr. and Meth., 95 (1971) 453). The required areas are in the order of sq.cm to sq.m, and the deviations from the desired field density distribution are in the order of magnitude $10^{-3}$ to $10^{-5}$ of the rated value. Up to now, the deviations of the real field from the nominal field have been compensated by floating pole shoes (Purcell filter, U.S. Pat. No. 2,962,636) or by the so-called shimming (precise removal of pole shoe material or applying of iron foils to the pole shoes).

The deviation from a homogeneous field distribution can be reduced by a Purcell filter only to the extent that it is caused by the magnet yoke. Also, the losses and further cost progressively rise with the area size.

With shimming, not only field distributions can be homogenized, but also a desired structure may be introduced into the field distribution. The process is quite complex, however, in particular, if material is to be removed from the pole shoe surfaces. A further essential disadvantage is that the effect of shimming subsequently cannot be varied any more and the effect also depends on the operating point of the magnet (magnitude of the magnetic flux density).

SUMMARY OF THE INVENTION

It is, therefore, the object of the present invention to avoid the disadvantages of the field correction methods conventional up to now and nevertheless to homogenize predetermined field distributions or to achieve desired field distributions. With the modern possibilities of the art (machine drawing, reproduction, printed circuits), very thin correction elements may be produced conveniently and cheaply (see German Pat. No. 2,107,770). A second advantage is the universal applicability, the fact that the correction elements can be electrically controlled and switched on and off and, last but not least, combined, and require only low currents as compared with other methods such as $H_t$ windings discussed in K. Halbach; Nuclear Instr. and Meth., 107 (1973) 515.

BRIEF DESCRIPTION OF THE DRAWINGS

The invention will be better understood from the following detailed description thereof taken in conjunction with the accompanying drawings in which.

DESCRIPTION OF THE PREFERRED EMBODIMENTS

In a magnet, the actually existing real field more or less strongly deviates from the required field distribution. By applying two current conducting foils at the two pole shoe surfaces, an additional field is generated in the magnet. The current distribution in the foils is adjusted in such a way that the additional field just compensates for the deviation between actual and required field distribution.

For the current density i necessary for the generation of a field $\vec{B}=(B_n,B_t)$, the following applies from H. Wollnik, Nucl. Instr. and Meth. 103 (1972) 479:

$$i=B_t/\mu_0 \tag{1}$$

$$\mu_o=4\pi\cdot10^{-7}\ \text{Asec/Vm}$$

Figure 1:
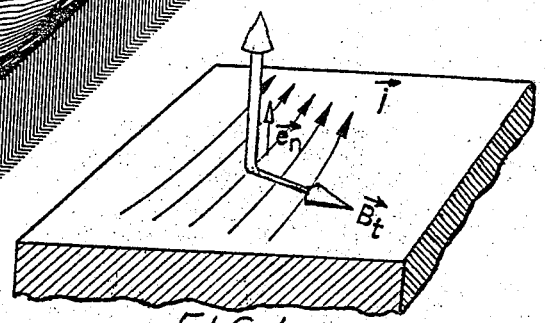
FIG. 1 shows a magnetic field produced by a current density $\vec{1}$, distributed in an iron block, divided into a component $B_t$ in parallel to the iron surface and a component $B_n$ in standard direction $e_n$ perpendicular to the iron surface.

The current therein flows normal to the direction of the tangential component $B_t$ (FIG. 1). When the tangential flux density $B_t$ is unknown, the current density i can be determined approximately from the normal component $B_n$ of the flux density B. In this case, there will result with sufficient accuracy in instances close to practice reported in: U. Czok, H. Wollnik, G. Moritz, Nucl. Instr. and Meth., in print:

$$i=G_o\cdot\text{grad}\ (B_n)/\mu_o \tag{2}$$

wherein $G_o$ is half the pole shoe spacing. Therein, the current direction is normal to the direction of the gradient.

For approximately homogeneous fields, $B_n \approx B$ (see U. Czok, H. Wollnik, G. Moritz, Nucl. Instr. and Meth., in print. In these instances:

$$i=G_o\cdot\text{grad}\ (B)/\mu_o \tag{3}$$

Figure 2A:
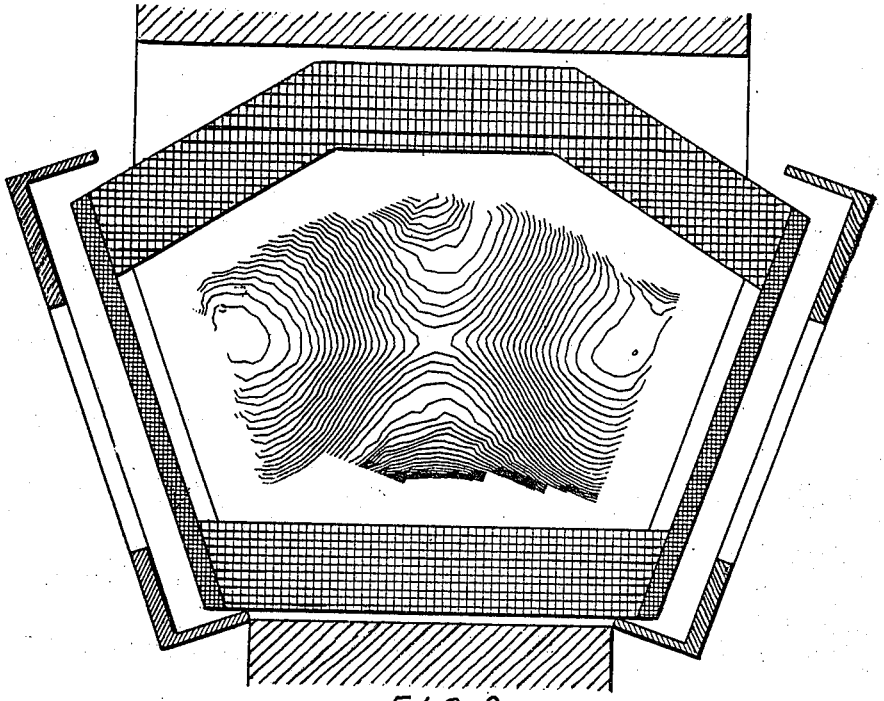
FIG. 2*a* shows a measured field distribution on the top pole shoe surface and FIG. 2*b* shows a measured field in the lower pole shoe surface, the lines being of equal field intensity.
Figure 2B:
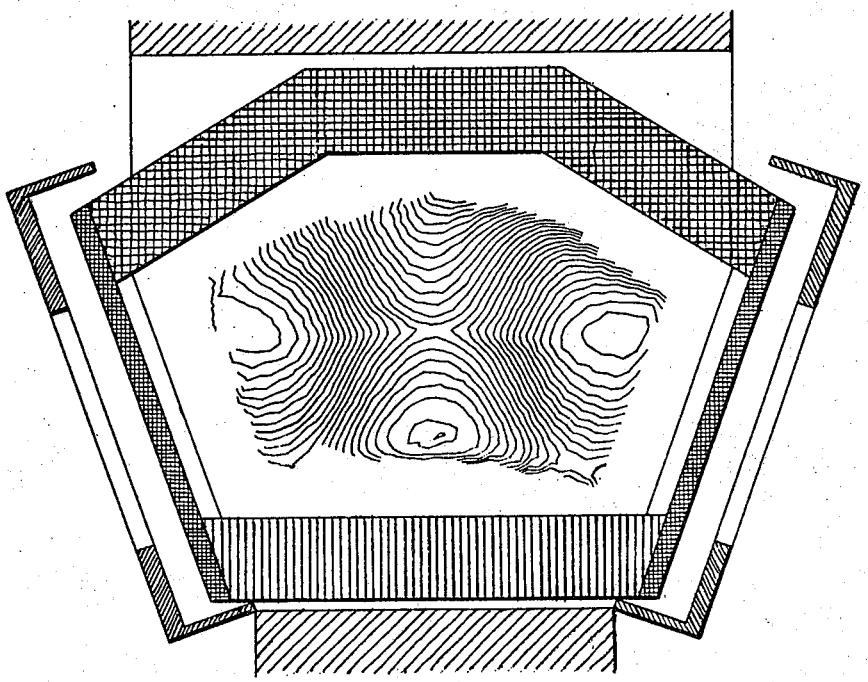

The realization of a current distribution at the pole shoe surfaces according to (2) and (3) is very simple. One will proceed in the following way discussed in U. Czok, H. Wollnik, G. Moritz, Nucl. Instr. and Meth., in print: Lines of equal field strength $B_n$ (or B) (measured at the two pole shoe surfaces) are drawn with a constant spacing $\Delta B_n$ ($\Delta B$) of the lines. FIG. 2*a* shows the upper pole shoe surface, and FIG. 2*b* shows the lower pole shoe surface. When now through the lines of equal field strength the current:

$$I=\Delta B \cdot G_o/\mu_o \text{ or } \Delta B_n G_o/\mu_o \quad (4)$$

flows, then just the current density according to (2) or (3) is produced. (Currents directly at the pole shoe surface, scale 1:1).

Figure 3:
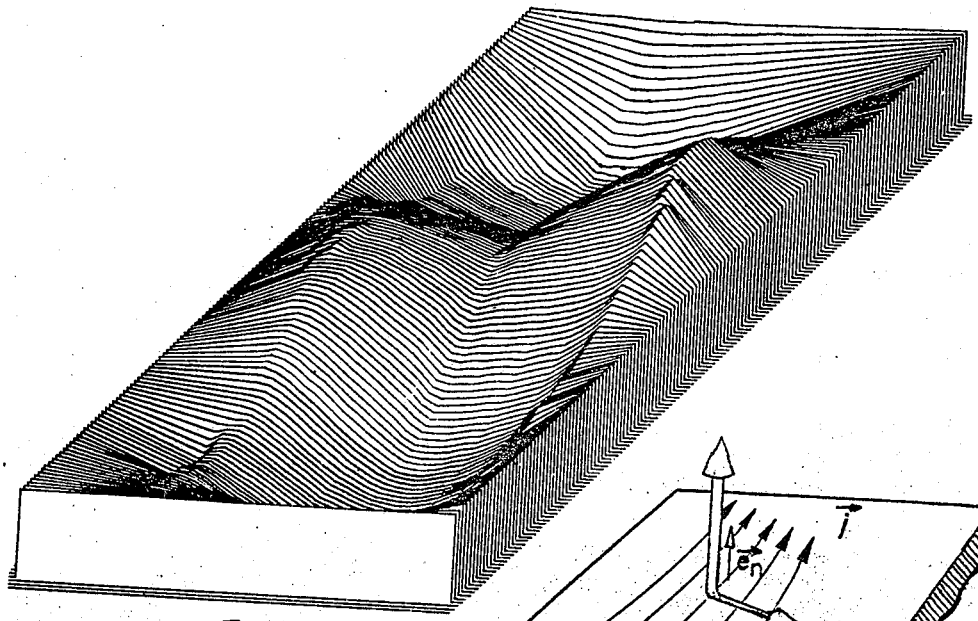
FIG. 3 shows the field distribution of FIG. 2 enlarged toward the outside by extrapolated field values in such a way that the field values are stable on the edge of the enlarged area and the field distribution is constant in the entire area.
Figure 4:
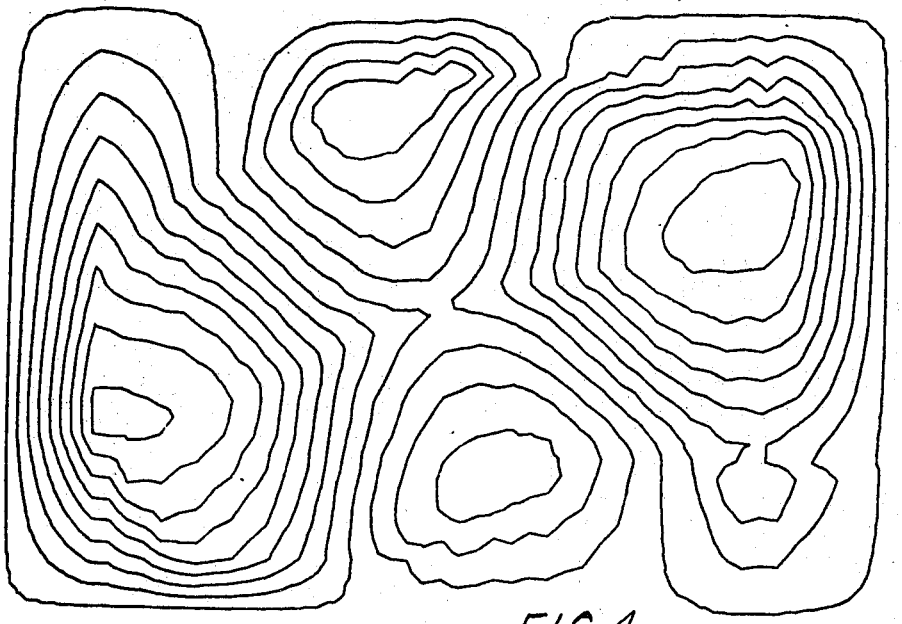
FIG. 4 shows all level lines of the same field intensity closed.
Figure 5:
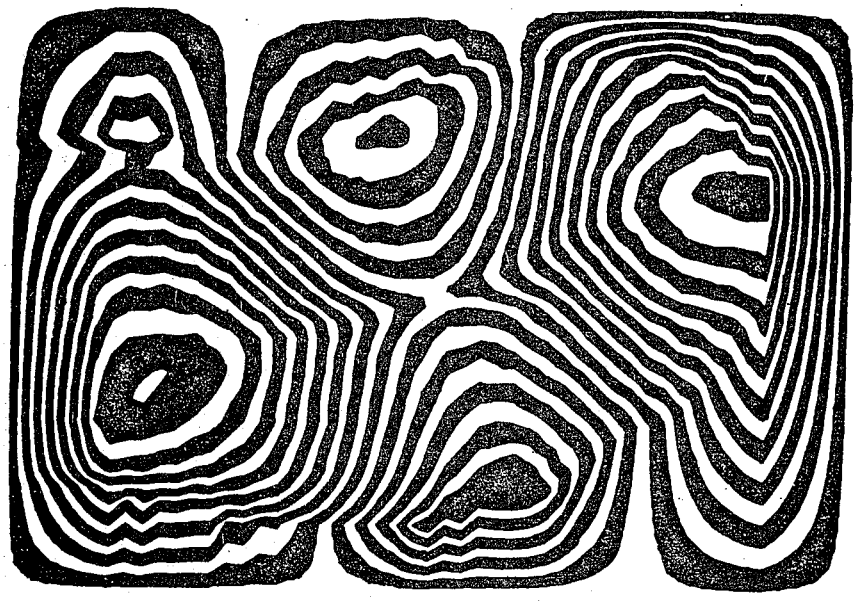
FIG. 5 shows the drawing of FIG. 4 with half the area between adjacent lines of flux blackened to define a plurality of closed electrical paths.

In the practical embodiment, the mountains of magnet flux density distribution about the actual measuring field will be extended outwardly, namely in such a way that the margin of the extended measuring field is disposed on a generally mean, but constant flux density value (FIG. 3). Thereby, all level lines are closed (FIG. 4). Also, between two adjacent level lines B and B+ΔB a third level line with the value B+ΔB/2 is drawn in, and the area between the level lines B and B+ΔB/2 is blackened. Thereby, a finite width of the current path is obtained. The value ΔB should be chosen such that the maximum width of the current path is selected according to the technical capability of the drawing, reproduction and etching method, i.e. about 1 mm (FIG. 5).

Figure 6:
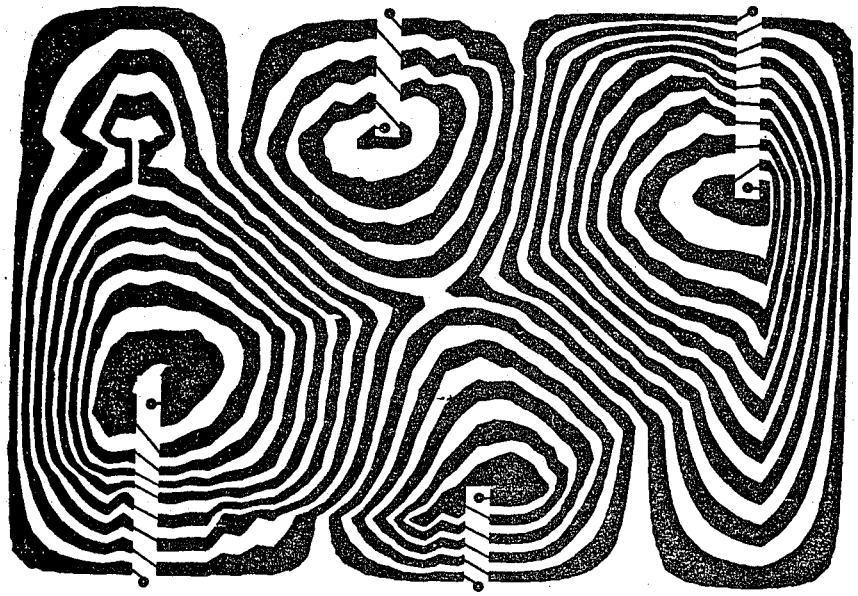
FIG. 6 shows the drawing of FIG. 5 with the closed paths opened and connected to form electrical paths in series.

The individual current paths are then separated and arranged in series with additional connections (FIG. 6). Thereby, the coils have only a low number of wire connections.

Figure 7:
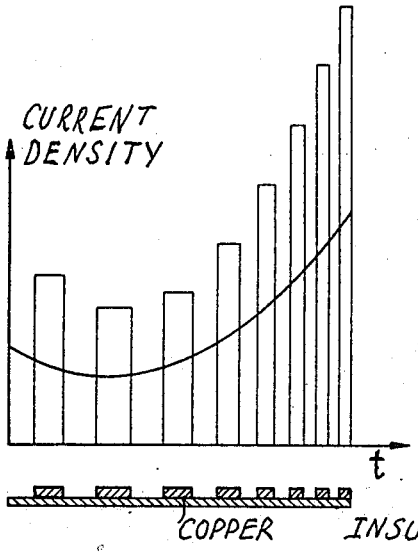
FIG. 7 is a cross-section through the correction coil of FIG. 6 and a corresponding graph showing current density.
Figure 9:
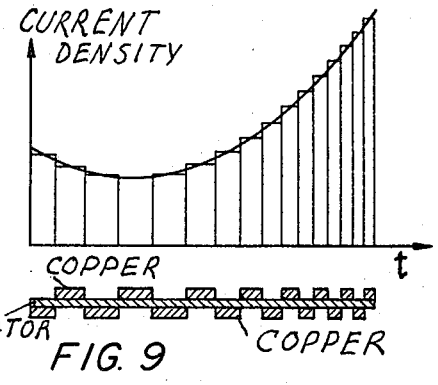
FIG. 9 is a cross-section through the correction coil of FIG. 8 and a corresponding graph showing current density.
Figure 8:
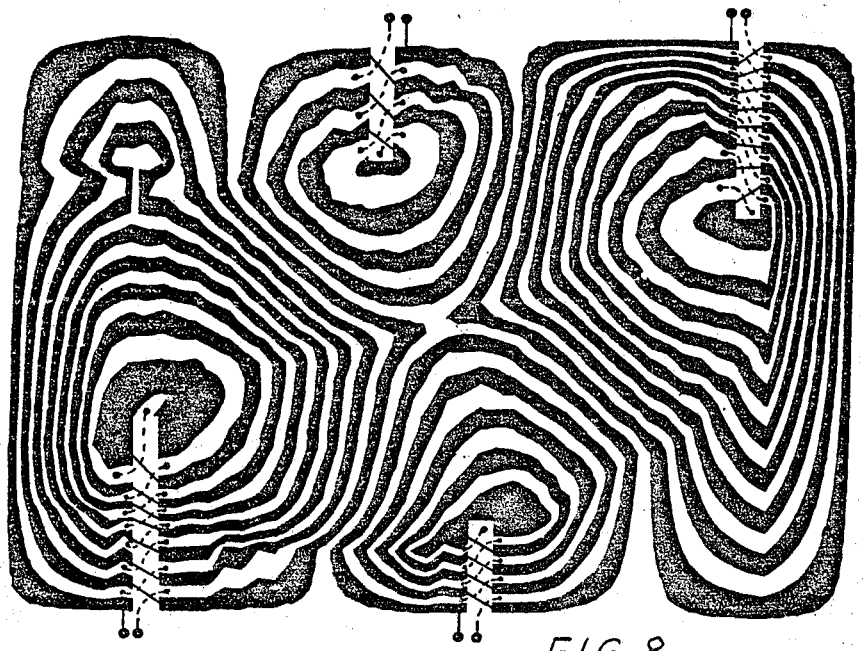
FIG. 8 shows another embodiment of the correction coil of FIG. 6 wherein a further conductive path is located between adjacent conductive paths of FIG. 6.

Even better would be to use material coated with copper on both sides. In this case, a current distribution complementary to FIG. 6 may be produced on the back side and thus a more uniform distribution of current density may be produced (FIGS. 7, 8 and 9). Additionally, the two-side current distribution has the advantage that the additional inferences by the transverse connections necessary for an arrangement in a series circuit mutually compensate at the front and rear side. Also, by a connection of the coils on both sides, further leads may be avoided.

Copper laminated material presently is commercially available with a copper coating of 35 μm and 70 μm. This permits quite good realization of area current densities of several A/mm. This permits the generation of still sufficiently high flux density variations. For a pole shoe spacing of 0.1 m, for instance field gradients of several $10^{-2}$ t/m can readily be achieved.

The field deviations of the required from the achieved magnet flux density vary greatly depending on the operation field strength in the magnet (U. Czok, H. Wollnik, G. Moritz, Nucl. Instr. and Meth., in print). Therefore, the correction must be easily controllable. This can easily be realized in the correction coils through the coil current. For greatly differing operational conditions wherein the field deviations not only deviate in amplitude, but also in the local distribution, a switching over may be effected between differently formed correction coils or also intermediate values may be interpolated, when using correction coils (U. Czok, H. Wollnik, G. Moritz, Nucl. Instr. and Meth., in print).

The invention may be embodied in other specific forms without departing from the spirit or essential characteristics thereof. The embodiments are therefore to be considered in all respects as illustrative and not restrictive.

What is claimed is:

1. An arrangement for homogenizing a magnetic field between two pole shoe surfaces of a magnet comprising:

(a) at least one correction coil adjacent to each pole shoe surface;

(b) each coil comprising a carrier of insulating material, an areal arrangement of a plurality of electrically conductive strips fixed to at least one side thereof and located along lines of magnetic flux and mutually spaced by a stable magnetic field intensity, the width of said electrically conductive strips corresponding to a predetermined fraction of the field intensity difference between adjacent strips, and means connecting said electrically conductive strips in series to form at least one current circuit.

2. The arrangement of claim 1 further comprising a plurality of additional electrically conductive strips affixed to the opposite side of said carrier and extending along the gaps between said conductive strips affixed to said one side and means connecting said additional strips in series to form at least one additional current circuit.

3. The arrangement of claim 2 wherein said conductive strips are arranged such that the current flows on said one side of said carrier in the area between the lines of the field intensity B and B+ΔB/2 and on said other side between the lines of the field intensity B+ΔB/2 and B+ΔB, wherein B represents the lines of equal field intensity and ΔB represents the stable distance between said lines.

4. The arrangement of claim 2 wherein the means connecting said electrically conductive strips in series on said one side of said carrier extend across the means connecting the additional electrically conductive strips on the opposite side of said carrier.

5. The arrangement of claim 1 wherein said conductive strips are arranged such that the current flows on said one side of said carrier in the area between the lines of the field intensity B and B+ΔB/2, wherein B represents the lines of equal field intensity and ΔB represents the stable distance between said lines.

6. The arrangement of claim 1 wherein a plurality of said correction coils are placed adjacent to each pole shoe surface, each coil being optimal for a different field intensity, whereby an electrical current may be passed through selected ones of said correction coils, depending on the field intensity of said pole shoe surfaces, to provide a homogenized magnetic field.

7. The arrangement of claim 1 wherein said electrically conductive strips comprise copper material coated on said carrier.

8. A process for homogenizing a magnetic field between two pole shoe surfaces of a magnet comprising:

(a) placing at least one correction coil adjacent to each pole shoe surface;

(b) each coil comprising a carrier of insulating material, an areal arrangement of a plurality of electrically conductive strips fixed to at least one side thereof and located along lines of magnetic flux and mutually spaced by a stable magnetic field intensity, the width of said electrically conductive strips corresponding to a predetermined fraction of the field intensity difference between adjacent strips, and means connecting said electrically conductive strips in series to form at least one current circuit; and (c) passing electrical current through said coils to homogenize said magnetic field.

9. The process of claim 8 wherein each of said carriers includes a plurality of additional electrically conductive strips affixed to the opposite side thereof which extend along the gaps between said conductive strips affixed to said one side and means connecting said additional strips in series to form at least one additional current circuit, said process comprising passing electrical current through said conductive strips on both sides of each of said carriers to homogenize said magnetic field.

10. The process of claim 8 wherein a plurality of said correction coils are placed adjacent to each pole shoe surface, each coil being optimal for a predetermined field intensity, said process comprising passing electrical current through selected ones of said correction coils, depending on the field intensity at said pole shoe surfaces, to provide a homogenized magnetic field.

* * * * *